US005941113A

United States Patent [19]

Kanemitsu et al.

[11] Patent Number: 5,941,113

[45] Date of Patent: Aug. 24, 1999

[54] METHOD OF FORMING A CYLINDRICAL PORTION OF A CYLINDRICAL MEMBER MADE OF A METAL SHEET

[75] Inventors: Toshiaki Kanemitsu, Kobe; Kunihiro Harada, Miki; Naoki Fujii, Kobe, all of Japan

[73] Assignee: Kabushiki Kaisha Kanemitsu, Hyogo, Japan

[21] Appl. No.: 09/029,866

[22] PCT Filed: Aug. 5, 1996

[86] PCT No.: PCT/JP96/02214

§ 371 Date: Mar. 17, 1998

§ 102(e) Date: Mar. 17, 1998

[87] PCT Pub. No.: WO98/05447

PCT Pub. Date: Feb. 12, 1998

[51] Int. Cl.[6] ..... B21H 1/18

[52] U.S. Cl. ..... 72/82; 72/110

[58] Field of Search ..... 72/68, 83, 85, 72/110, 82; 29/892, 892.3, 893.32, 894.342

[56] References Cited

FOREIGN PATENT DOCUMENTS 024705 2/1980 Japan ..... 72/85

62-238036 10/1987 Japan .

1-233032 9/1989 Japan .

*Primary Examiner*—Lowell A. Larson

*Attorney, Agent, or Firm*—Jones, Tullar & Cooper, P.C.

[57] ABSTRACT

A method of forming a cylindrical portion of a cylindrical member made of a sheet metal according to the present invention relates to steps of rotating a cylindrical member fitted into rotating dies with the rotating dies while pressing the cylindrical portion against the rotating dies by the forming roller. In the present invention, a pressed portion of the cylindrical portion, pressed by a forming roller is moved from an opening end side of the cylindrical portion to a root portion side thereof according to each phase. For example, the pressed portion of the cylindrical portion pressed by the forming roller includes two sections, namely a first phase-pressed portion positioned on the opening end side of the cylindrical portion and a second phase-pressed portion positioned on the root portion side thereof. Previously, the first phase-pressed portion was pressed by the forming roller to be thinned and extended, and after that, the second phase-pressed portion is pressed by the forming roller to be thinned and extended, so that the cylindrical portion obtained by the above steps is not widened toward the end.

5 Claims, 8 Drawing Sheets

810
1
3
800
32
31
710
800
810
2
l
k
31
32
3
13
33
700
700

METHOD OF FORMING A CYLINDRICAL PORTION OF A CYLINDRICAL MEMBER MADE OF A METAL SHEET

CROSS REFERENCE TO RELATED APPLICATION

This application discloses subject matter in common with application, Ser. No. 09/029,265, filed on Mar. 10, 1998.

TECHNICAL FIELD

The present invention relates to a method of forming a cylindrical portion of a cylindrical member made of a sheet metal, the cylindrical portion being connectedly disposed on an outer periphery of a base plate of the cylindrical member. Specifically, the present invention relates to a method of forming the cylindrical portion of the cylindrical member made of the sheet metal, so that it has sufficient thickness and a length suitable for providing a belt winding portion around which a flat belt, a V-shaped belt, a poly-V-belt or the like are to be wound, and teeth on an inner surface or an outer surface of the cylindrical portion.

BACKGROUND OF THE INVENTION

A method of forming a cylindrical member connectedly provided with a cylindrical portion arranged at an outer periphery of a circular base plate, and projecting to one side, by means of employing a sheet metal as a base material, is known wherein pressing dies are employed to draw an outer periphery of the sheet metal, and shape it in a cylindrical state, thereby forming the base plate and the cylindrical portion.

The cylindrical portion of the cylindrical member formed by the present method has substantially the same thickness as that of the base material or the sheet metal. In forming a pulley, a gear or the like by use of such a cylindrical member, it is often required to decrease the thickness of the cylindrical portion and increase the length thereof.

SUMMARY OF THE INVENTION

It is an object of the present invention to provide a method of forming a cylindrical portion of a cylindrical member made of a sheet metal, so that the thickness of the cylindrical portion arranged on the cylindrical member and the length thereof can be respectively decreased or increased.

In order to achieve the above object, a method of forming a cylindrical portion of a cylindrical member made of a sheet metal according to the present invention, comprises the steps:

- fitting a cylindrical portion of a cylindrical member having a base plate whose outer periphery is connectedly provided with the cylindrical portion projecting to one side of the base plate, into rotating dies,
- making the cylindrical member rotate with the rotating dies,
- pressing the cylindrical portion by a forming roller against the rotating dies, so as to thin the cylindrical portion, and extend it axially,
  - wherein a pressed portion of the cylindrical portion pressed by the forming roller is moved according to phases, from an opening end side of the cylindrical portion to a root portion side thereof.

By performing the method, the cylindrical portion is not widened toward the end (in a wide-based state like a trumpet-shape), and it is subjected to thinning and extending. The reasons why thinning and extending is performed are described below.

As shown in FIG. 8, a cylindrical portion 2 of the cylindrical member 1 is fitted into a rotating die R1, the cylindrical member 1 is rotated with the rotating die R1 while pressing a full length of the cylindrical portion 2 against the rotating die RI by means of a forming roller R2, so that the cylindrical portion 2 is thinned and axially extended. However, in this case, the cylindrical portion 2 extended by shaping is widened toward the end. The reasons will be presumed as follows. A thickness of the cylindrical portion 2 subjected to pressure by the forming roller R2 plastically flows to the opening end side of the cylindrical portion 2 in a lower direction, as indicated by arrows in the figure, with the result that the cylindrical portion 2 is thinned while it is axially extended. On the other hand, when the pressure exerted by the forming roller R2 is released, a phenomenon of restoring the thickness occurs, wherein the thickness of the cylindrical portion 2 plastically flows in a reverse direction, to a certain degree. Consequently, the extended cylindrical portion 2 is shrunken at an outer periphery thereof so that the cylindrical portion 2 is widened toward the end. An arrow P indicates a pressing direction by the forming roller R2.

On the other hand, according to the present invention, in case of employing the method wherein the cylindrical portion of the cylindrical member fitted into the rotating dies is pressed against the rotating dies by the forming roller to be thinned and extended axially, the pressed portion of the cylindrical portion pressed by the forming roller is moved from the opening end side of the cylindrical portion to the root portion thereof according to each phase, the portion previously extended functions to restrict widening the portion extended subsequently. Accordingly, the cylindrical portion is not widened toward the end and it is subjected to thinning and extending.

In the case that the pressed portion of the cylindrical portion pressed by the forming roller is moved from the opening end side of the cylindrical portion to the root portion side thereof according to the each phase, the present invention makes it possible that the pressed portions of the cylindrical portion pressed by the forming roller includes two sections, namely, a first phase-pressed portion of the opening end side thereof and a second phase-pressed portion of the root portion side thereof, and thinning and extending at the first phase-pressed portion is previously performed and further thinning and extending at the second phase-pressed portion is subsequently performed. Thus, the first phase-pressed portion of the cylindrical portion is previously extended, the first phase-pressed portion thereof functions as a restricting state wherein the second phase-pressed portion subsequently extended is widened.

According to the present invention, in pressing the pressed portion of the root portion side of the cylindrical portion by the forming roller, it is allowed to extend the cylindrical portion in both sides of an axial direction. This enables the effective diameter of the formed cylindrical portion to be increased.

Furthermore, in case of pressing the pressed portion on and after at least the second phase by use of the forming roller, there is desirably a clearance between the cylindrical portion and the rotating dies. This ensures that plastic transformation of the root portion side of the cylindrical portion is fully performed so as to prevent the cylindrical portion from widening toward the end.

DETAILED DESCRIPTION OF THE PREFERRED EMBODIMENTS

Figure 2:
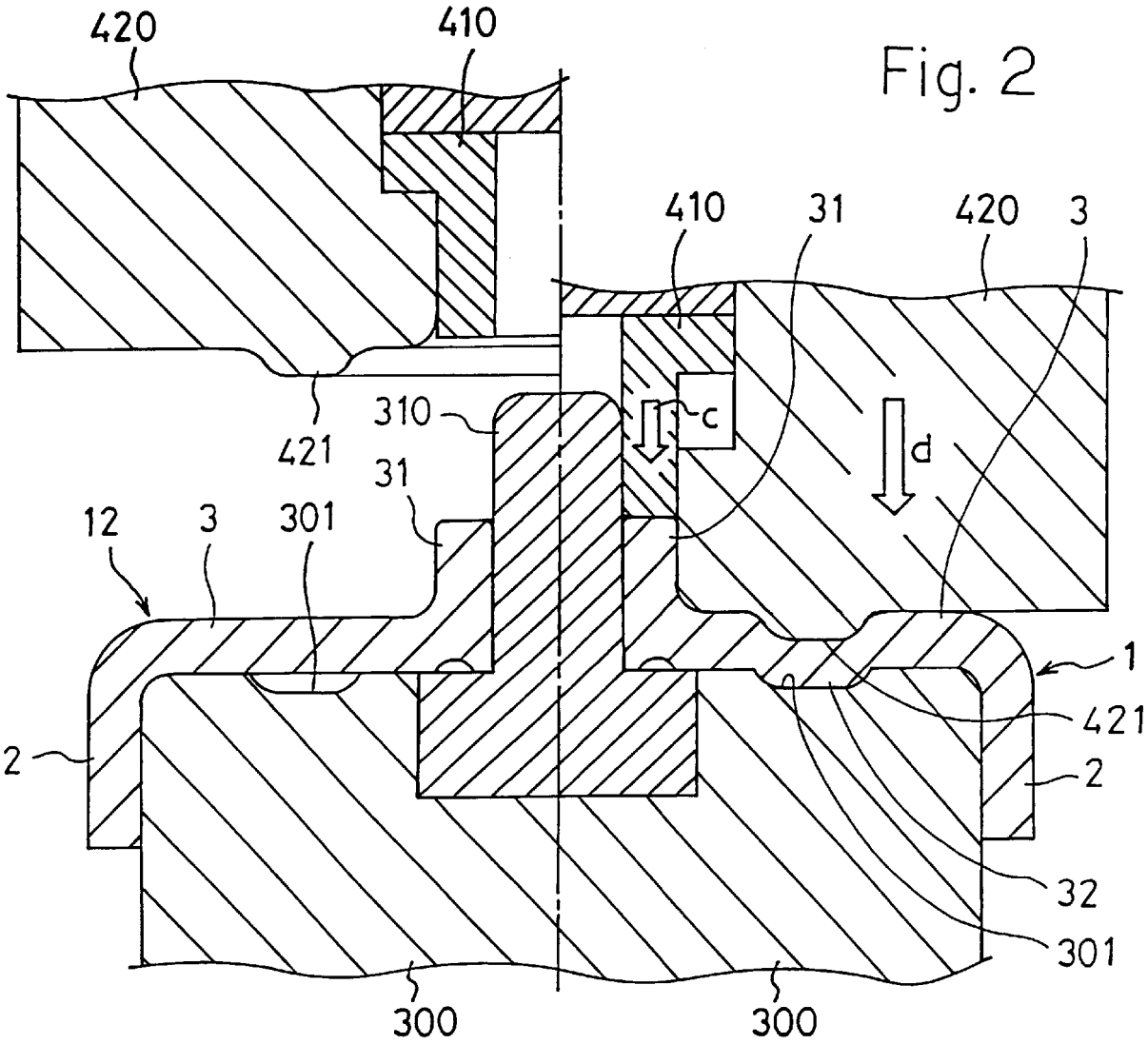
In FIG. 2, the left half thereof is a sectional view illustrating a pre-step prior to an extruding portion forming step of forming an extruding portion at a base plate of the sheet metal material, and the right half thereof is a sectional view illustrating the extruding portion forming step of forming the extruding portion at the base plate of the sheet metal material.

As shown in the right half in FIG. 2, a cylindrical member 1 made of a sheet metal employed for a method of forming a cylindrical portion according to the present invention, has a boss portion 31 protrusively disposed on a center of a circular base plate 3, and a cylindrical portion 2 extending an either side of the base plate 3, so as to be integrated with an outer periphery of the base plate 3. Moreover, the base plate 3 is provided with an extrusive portion 32 extruding to a rear side thereof so as to be concentrical with the boss portion 31. The boss portion 31 is connectedly arranged on the base plate 3 by a burring process or the like so as to be integrated therewith.

Figure 1:
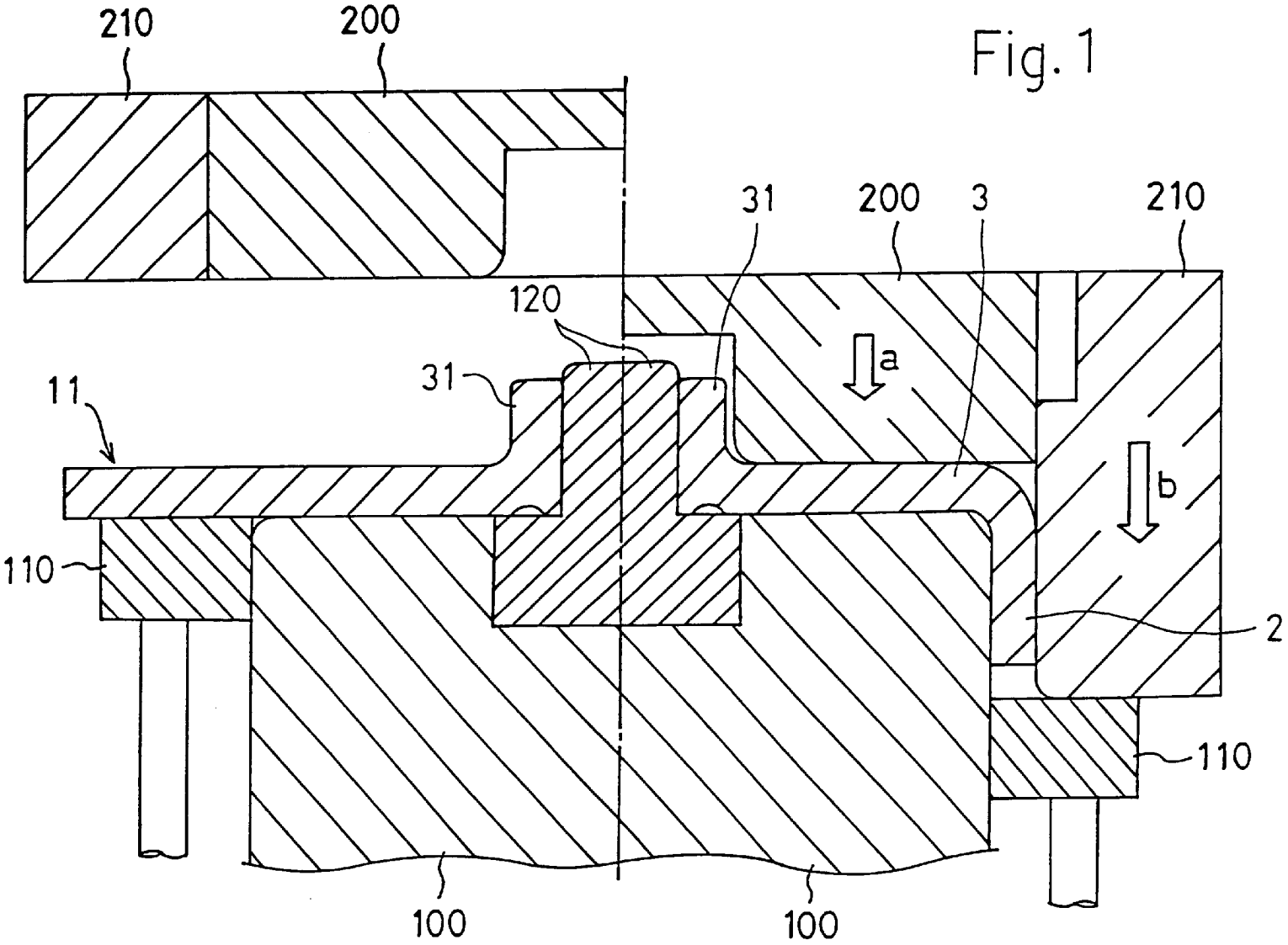
In FIG. 1, the left half thereof is a sectional view illustrating a pre-step prior to a cylindrical portion forming step of forming a cylindrical portion at a sheet metal material integrated with a boss portion according to the present invention, and the right half thereof is a sectional view illustrating the cylindrical portion forming step of forming the cylindrical portion at the sheet metal material integrated with the boss portion according to the present invention.

Concretely, as shown in FIG. 1, the cylindrical portion 2 is formed by a pre-step prior to a cylindrical portion forming step. In other words, as shown in the left half in FIG. 1, a sheet metal material 11 integrally having the boss portion 31 is mounted on a lower die 100 and a movable lower die 110 arranged at a circumference thereof, and a rod portion 120 arranged on the lower die 100 is fitted into the boss portion 31, thereby positioning the metal sheet member 11 by the rod portion 120. As shown in the right half in FIG. 1, a holding upper die 200 and a pressing upper die 210 arranged at a circumference thereof are lowered in the direction of arrows a and b, the base plate 3 is pushed against the lower die 100 by the holding upper die 200, thereby holding the base plate 3 between the holding upper die 200 and the lower die 100 and bending the outer periphery of the base plate 3 by the use of the pressing upper die 210 so as to form the cylindrical portion 2. That is, it is a drawing process.

The extrusive portion 32 is obtained by a pre-step prior to an extrusive portion forming step and the extrusive portion forming step as concretely shown in FIG. 2. In other words, as shown in the left half in FIG. 2, a sheet metal material 12 integrally having the boss portion 31 is mounted on a lower die 300 and a rod portion 310 arranged on the lower die 300 is fitted into the boss portion 31, thereby positioning the sheet metal material 12 by use of the rod portion 310. As shown in the right half in FIG. 2, a holding upper die 410 and a pressing die 420 arranged at a circumference thereof are lowered in the direction of arrows c and d, and the holding upper die 410 makes the boss portion 31 held pushingly so that the boss portion 31 is interposingly held between the holding upper die 410 and the lower die 300, and a radially middle portion of the base plate 3 is pressed downwardly by a circularly annular protrusion 421 arranged on the pressing upper die 420, thereby extruding the pressed portion into a circularly annular concave area 301 arranged at the lower die 300.

The cylindrical portion 2 of the cylindrical member 1 obtained by the steps illustrated in FIGS. 1 and 2 is subjected to the cylindrical portion forming step according to the present invention. In this embodiment, the step is divided into a first phase step in the right half in FIG. 3 and a second phase step in the right half in FIG. 4.

Figure 3:
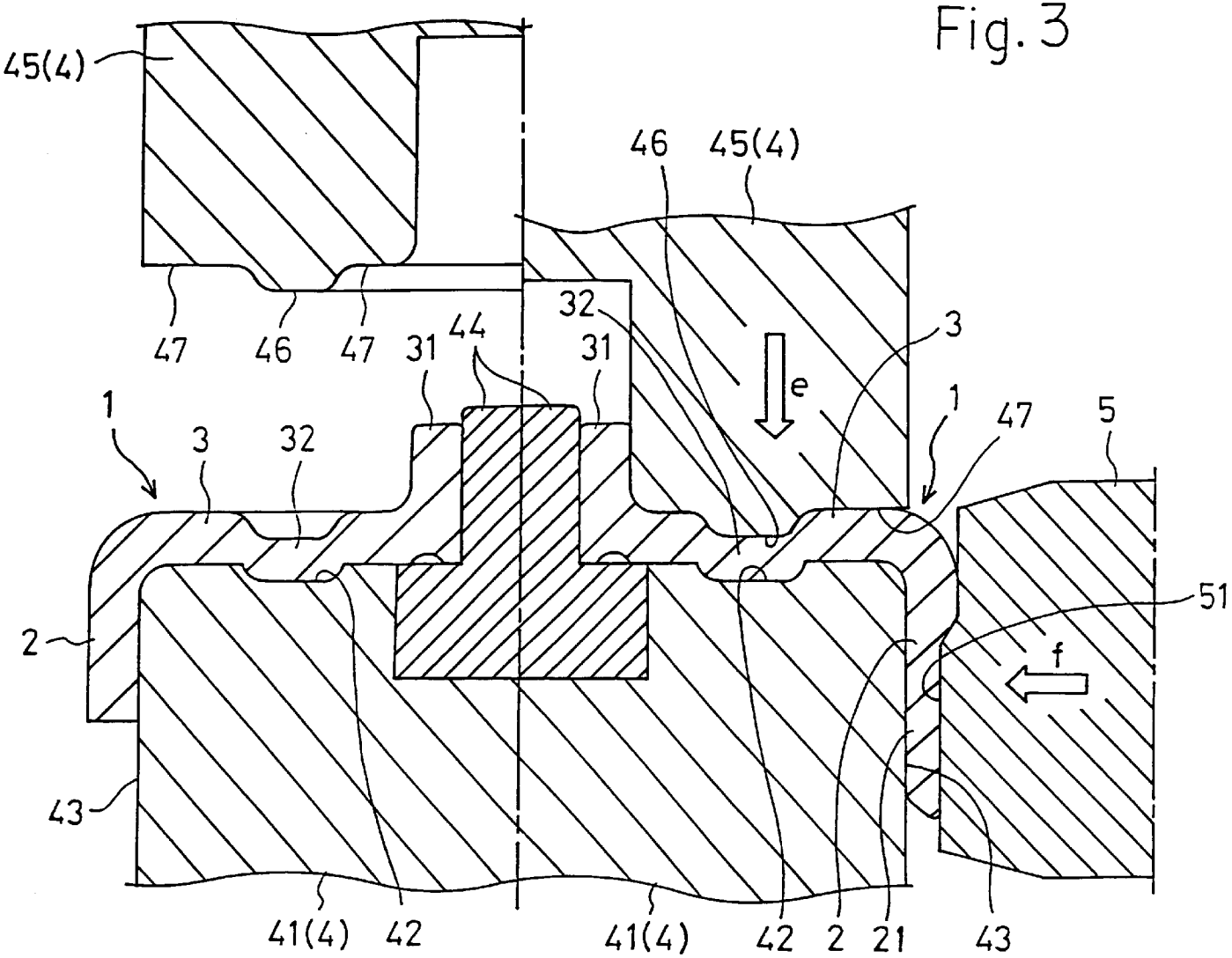
In FIG. 3, the left half is a sectional view illustrating a pre-step prior to a first phase step of extending the cylindrical portion of the sheet metal material, and the right half thereof is a sectional view of the first phase step of extending the cylindrical portion of the sheet metal material.

In the first phase step, rotating dies 4 having the function of holding the base plate 3 of the cylindrical member 1, and a forming roller 5 for pressing the cylindrical portion 2 in a radially inward direction of the base plate 3 are employed. As shown in FIG. 3, the rotating dies 4 include a first rotating die 41 and a second rotating die 45. The first rotating die 41 is provided with an annular concave recess surface 42 overlapped with the extrusive portion 32, a cylindrical supporting face 43 into which the cylindrical portion 2 is fitted, and a rod portion 44 projecting to a position concentric with a rotating axis core. On the other hand, the second rotating die 45 is provided with an annular convex surface 46 overlapped with the extrusive portion 32, and a holding surface 47 positioned on both sides of the convex surface 46. Moreover, the forming roller S has a cylindrical pressing-shaping surface 51.

Figure 4:
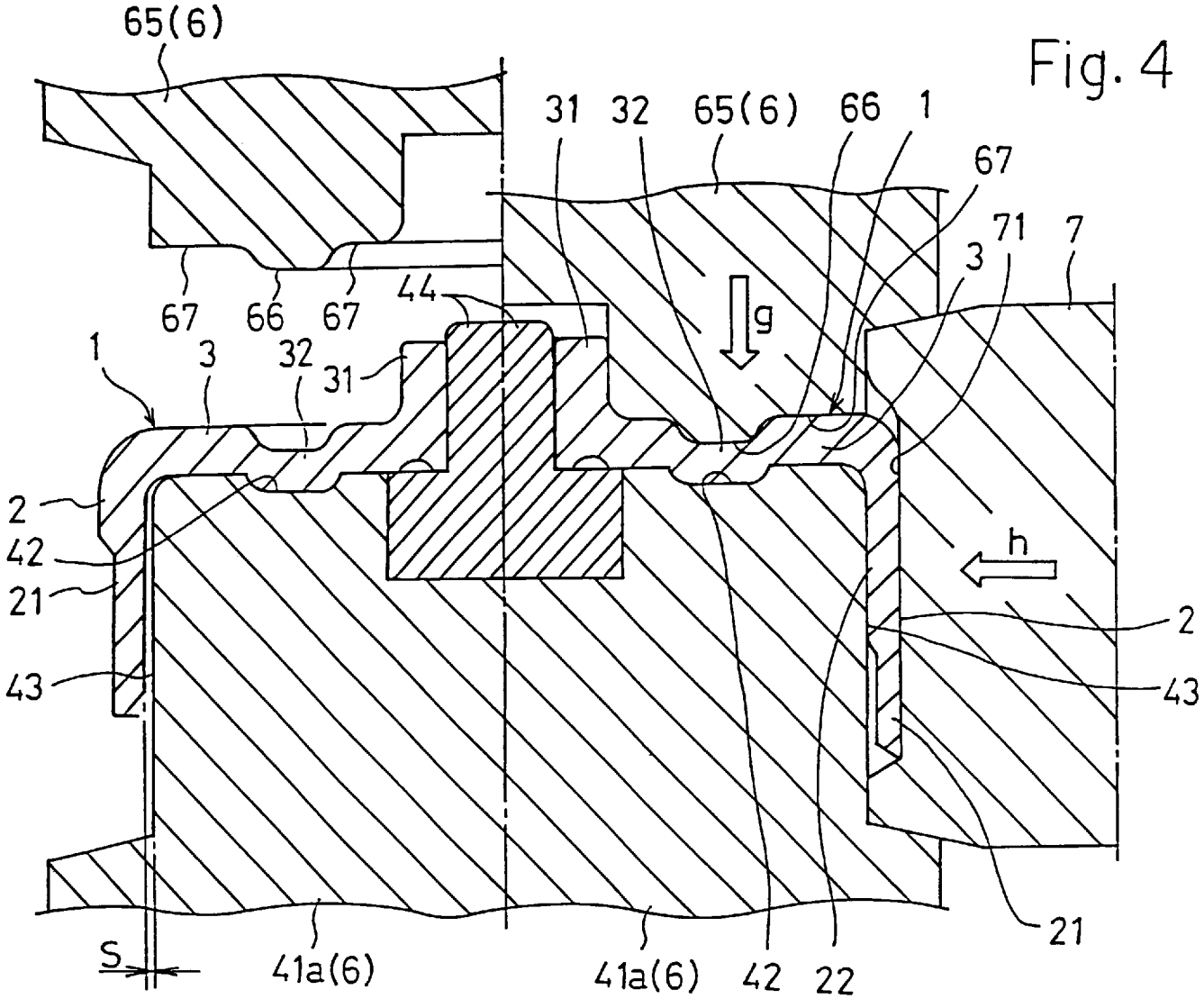
In FIG. 4, the left half is a sectional view illustrating a pre-step prior to a second phase step of extending the cylindrical portion of the sheet metal material, and the right half thereof is a sectional view of the second phase step of extending the cylindrical portion of the sheet metal material.

Also, in the second phase step, rotating dies 6 having the function of holding the base plate 3 of the cylindrical member 1, and a forming roller 7 for pressing the cylindrical portion 2 in a radially inward direction of the base plate 3 are employed. As shown in FIG. 4, the rotating dies 6 include another first rotating die 41*a* having a slightly smaller diameter than the first rotating die 41 in FIG. 3 and a second rotating die 65 pairing with the first rotating die 41*a*. In the same manner as the second rotating die 45 in FIG. 3, the second rotating die 65 is provided with an annular convex surface 66 and a holding surface 67. Moreover, the forming roller 7 has a cylindrical pressing-shaping surface 71.

As shown in the left half in FIG. 3, in the pre-step prior to the first phase step, the cylindrical portion 1 integrally having the boss portion 31 is mounted on the first rotating die 41, the extrusive portion 32 of the base plate 3 is overlapped with the concave recess surface 42 of the first rotating die 41 in a fitted state, so that the cylindrical member 1 is fixed so as not to move radially, and the rod portion 44 of the first rotating die 41 is fitted into the boss portion 31, thereby positioning the cylindrical member 1 by use of the rod portion 44, and fitting the cylindrical portion 2 of the cylindrical member 1 into the first rotating die 41. Thereafter, the first phase step is conducted.

In the first phase step, the second rotating die 45 is lowered in the direction of an arrow e, the convex surface 46 is overlapped with a rear surface of the convex portion 32 in a fitted state, the base plate 3 of the cylindrical member 1 is held between the first rotating die 41 and the second rotating die 45 by a great force so as to transmit rotation to either the first rotating die 41 or the second rotating die 45, thereby rotating the cylindrical member 1 with the first rotating die 41 and the second rotating die 45. While the cylindrical member 1 is rotated, the forming roller 5 is moved in the direction of an arrow f, thus pressing a first phase-pressed portion assigned as a lower half portion of the divided cylindrical portion 2 against the supporting face 43 of the first rotating die 41. Thus, the forming roller 5 rotatably follows the cylindrical member 1, the first phase-pressed portion of the cylindrical portion 5 or the lower half is thinned while it is gradually extended in an axially lower direction. In the right half in FIG. 3, the extended portion of the cylindrical portion 2 (the first phase-pressing portion) is designated by a reference numeral 21.

After thinning and extending the first phase-pressed portion of the cylindrical portion 2 in the first phase step, a pre-step prior to a second phase step illustrated in the left half in FIG. 4 is conducted. In the pre-step, the cylindrical member 1 obtained by the first phase step is mounted on the other first rotating die 41*a* having a slightly smaller diameter than the first rotating die 41 (i.e., FIG. 3) employed in the first phase step, so that the extrusive portion 32 of the base plate 3 is overlapped with the concave recess surface 42 of the first rotating die 41*a* in a fitted state, whereby the cylindrical member 1 is fixed so as not to move the cylindrical member 1 radially, and the rod portion 44 of the first rotating die 41*a* is fitted into the boss portion 31, thus positioning the cylindrical member 1 by use of the rod portion 44, and the cylindrical portion 2 of the cylindrical member 1 is fitted into the first rotating die 41*a*. Accordingly, a slight clearance S is disposed between the first rotating die 41*a* and the cylindrical portion 2 of the cylindrical member 1. Then, the second phase step is conducted as shown in the right half in FIG. 4. An arrangement of the first rotating die 41*a* in FIG. 4 is the same as that of the first rotating die 41 except that the diameter of the supporting face 43 of the first rotating die 41*a* is smaller than that of the first rotating die 41. Therefore, corresponding portions are designated by the same reference numerals as the first rotating die 41. For the first rotating die 41*a* employed in the second phase step, the first rotating die 41 employed in the first phase step may be employed.

In the second phase step, as shown in the right half in FIG. 4, the second rotating die 65 is lowered in the direction of arrow g, the convex surface 66 is overlapped with the rear surface of the extrusive portion 32 of the base plate 3 in a fitted state, the base plate 3 of the cylindrical member 1 is held between the first rotating die 41*a* and the second rotating die 65 by a great force, thereby transmitting rotation to either the first rotating die 41*a* or the second rotating die 65, so as to rotate the cylindrical member 1 with the first rotating die 41*a* and the second rotating die 65. While rotating the cylindrical member 1, the forming roller 7 is moved in the direction of an arrow h, thereby pressing a second phase-pressed portion assigned as an upper half of the divided cylindrical portion 2 against the supporting face 43 of the first rotating die 41*a*. Thus, the forming roller 7 rotatably follows the cylindrical member 1, thereby thinning the second phase-pressed portion (or the upper half portion) of the cylindrical portion 2 while gradually extending it in an axially lower direction. In the right half in FIG. 4, an extended portion of the cylindrical portion 2 (the second phase-pressed portion) is designated by a reference numeral 22.

As shown in the right half in FIG. 3 and the right half in FIG. 4, the first phase-pressed portion corresponding to the lower half portion of the cylindrical portion 2 is thinned and extended in advance, and after that, the second phase-pressed portion corresponding to the upper half portion of the cylindrical portion 2 is thinned and extended, whereby, owing to the first phase-pressed portion previously extended, it is restricted to widen the second phase-pressed portion subsequently extended, so that the extended cylindrical portion 2 is not widened toward the end.

With this embodiment the forming rollers 5 and 7 are employed, so as to force pressure according to two phases, thereby thinning and extending a full length of the cylindrical portion 2. However, if it is desired to further increase a length of the cylindrical portion subsequent to extending, the number of the pressing portions are increased by disposing more phases, the pressed portions of the cylindrical portion pressed by the forming roller may be moved from an opening end side of the cylindrical portion to a root portion side thereof according to the phases. Thus, the portion previously extended functions to prevent the portion subsequently extended from widening. In addition, in the second phase step, the cylindrical portion 2 is pressed in a direction wherein the slight clearance S between the first rotating die 41*a* and the cylindrical portion 2 of the cylindrical member 1 disappears. This shows remarkably an effect of preventing the extended cylindrical portion 2 from widening toward the end.

Moreover, according to this embodiment, when the forming roller 5 and 7 are pressed in the radial direction of the base plate 3 of the cylindrical portion 2, the extrusive portion 32 of the base plate 3 is radially engaged with the concave recess surface 42 of the first rotating die 41 and the convex surface 46 of the second rotating dies 45 and 65 with the result that the pressure exerted by the forming rollers 5 and 7 is supported by the concave recess surface 42 and the convex surface 46. This prevents a state wherein, owing to an influence of the pressure by the forming rollers 5 and 7, a part of the boss portion 31 is strongly pressed against the rod portion 44 of the first rotating die 41. Therefore, accuracy as to be shape and measurements of an original boss portion 31 is maintained even after extending the cylindrical portion 2.

The cylindrical portion 2 of the cylindrical member 1 having the cylindrical portion 2 extended as mentioned above may be provided with a belt winding portion around which a flat belt, V-shaped belt, a poly-V-belt or the like are to be wound, and the teeth may be provided with an inner side and an outer side thereof.

Figure 5:
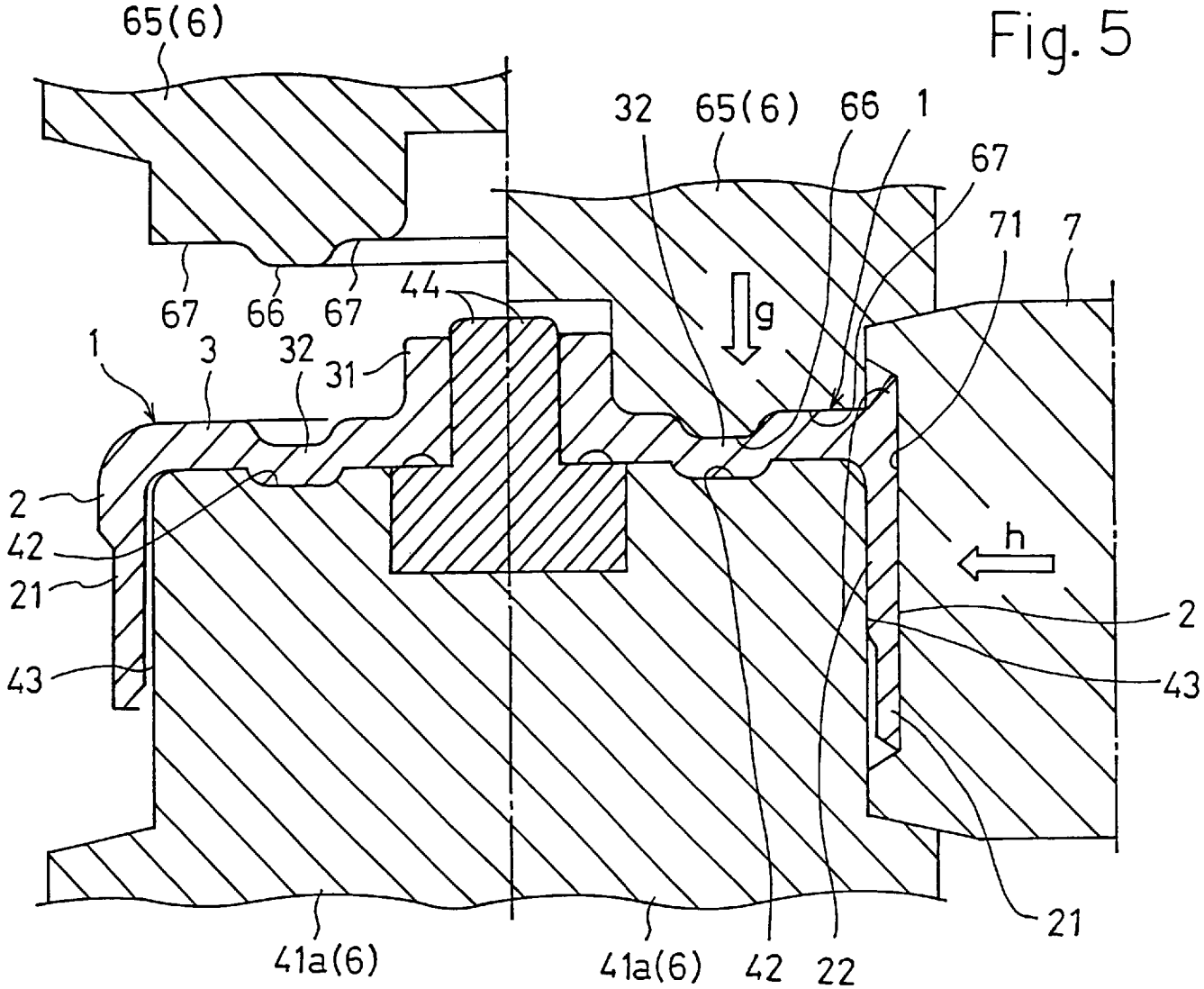
In FIG. 5, the left half is a sectional view illustrating a pre-step prior to a second phase step of extending a cylindrical portion of a cylindrical member, and the right half thereof is a sectional view of a modification of the second phase step of extending the cylindrical portion of the cylindrical member according to the embodiment as shown in the right half of FIG. 4.

FIG. 5 illustrates a case wherein the root portion of the cylindrical portion 2 of the cylindrical member 1 obtained by the above mentioned first phase step is simultaneously extended in the second phase step. In the second phase step illustrated in the right half in FIG. 5, the second phase-pressed portion of the cylindrical portion 2 as shown in the right half in FIG. 4 extends downwardly at the same time while it is also extended upwardly. In the second phase step shown in the right half in FIG. 5, the pressing-shaping surface 71 of the forming roller 7 is extended upwardly so as to make it possible to extend it to an upper side of the cylindrical portion 2.

As shown in FIG. 5, the second phase-pressed portion of the cylindrical portion 2 is extended downwardly at the same time while it is also extended upwardly, thereby having an advantage or enabling an effective diameter subsequent to extension to be increased. In FIG. 5, the same portions as the portions illustrated in FIG. 4, or the portions corresponding to those in FIG. 4 are designated by the same reference numerals and detail descriptions thereof are omitted.

Figure 6:
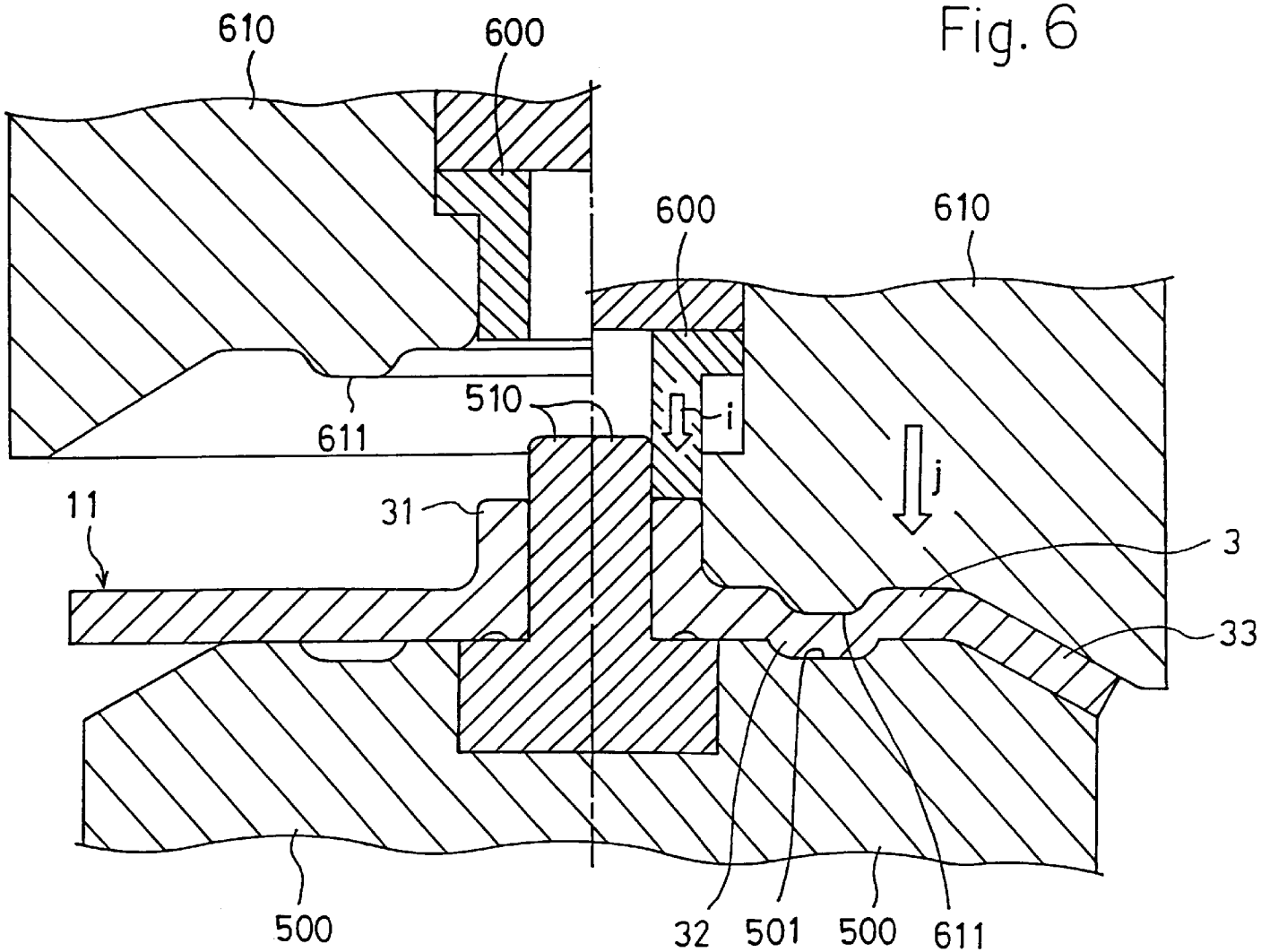
In FIG. 6, the left half is a sectional view illustrating a pre-step prior to a step of forming an inclining wall at a sheet metal material integrated with the boss portion, and the right half thereof is a sectional view of the step of forming the inclining wall at the sheet metal material integrated with the boss portion.
Figure 7:
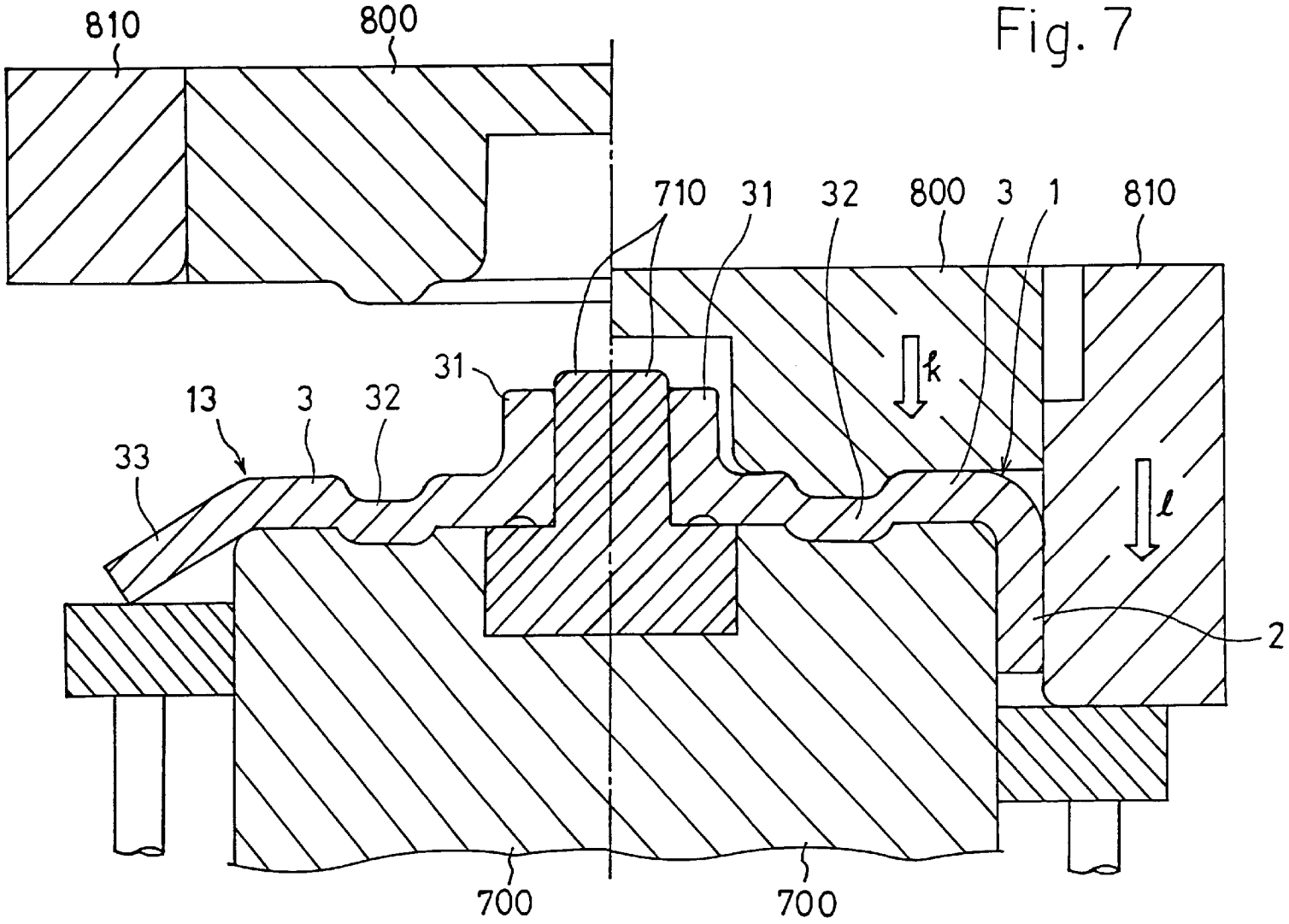
In FIG. 7, the left half is a sectional view illustrating a pre-step prior to a step of forming the inclining wall of the sheet metal material at the cylindrical portion thereof, and the right half thereof is a sectional view of the step of forming the inclining wall of the sheet metal material at the cylindrical portion thereof.
Figure 8:
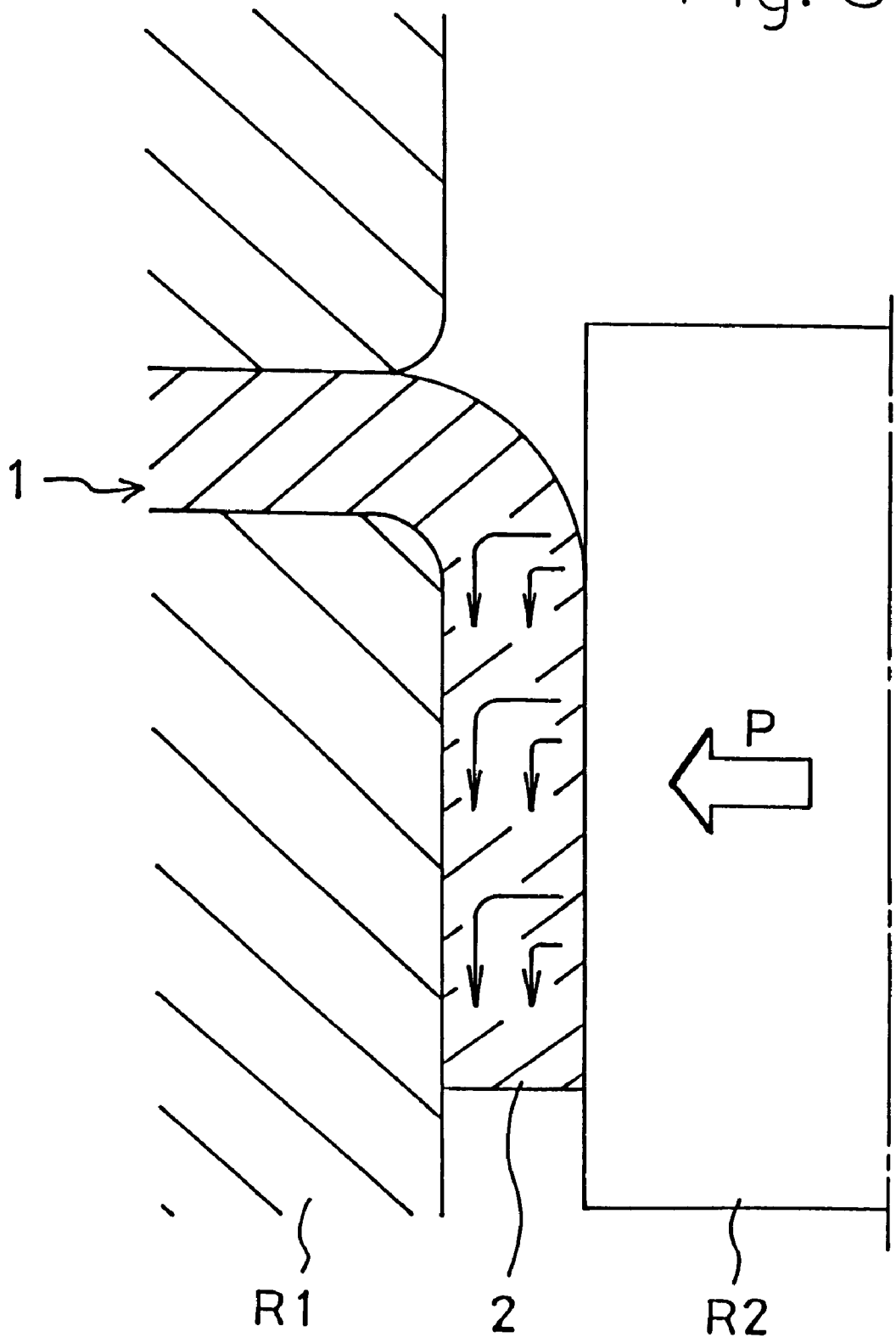
FIG. 8 is a diagram showing widening the formed cylindrical portion toward the end.

FIGS. 6 and 7 illustrate another embodiment for steps of forming the cylindrical portion 2 and the extrusive portion 32.

According to the step in FIG. 6, as shown in the left half in FIG. 6, the sheet metal material 11 integrally having the boss portion 31 is mounted on a lower die 500, and a rod portion 510 arranged at the lower die 500 is fitted into the boss portion 31, thereby positioning the sheet metal material 11 by use of the rod portion 510. As shown in the right half in the same figure, a holding upper die 600 and a pressing upper die 610 arranged at a circumference thereof are lowered in the direction of i and j, the holding upper die 600 makes the boss portion 31 pushingly held, thus holding the boss portion 31 between the holding upper die 600 and the lower die 500, and pressing a radially middle portion of the base plate 3 downwardly by a circularly annular projection 611 disposed on the pressing upper die 610, so as to extrude the pressed portion into a circularly annular concave area 501 disposed on the lower die 500. By undergoing the step, the convex portion 32 is disposed on the base plate 3. Furthermore, a predetermined range of an outer periphery of the sheet metal material 11 is held between the lower die 500 and the pressing upper die 610, so as to be inclined in a state of widening toward the end, thereby forming an inclining wall 33.

According to steps in FIG. 7, a sheet metal material 13 having the extrusive portion 32 and the inclining wall 33 is mounted on a lower die 700, and a rod portion 710 arranged at the lower die 700 is fitted into the boss portion 31, thereby positioning the metal sheet material 13 by use of the rod portion 710. In the right half in FIG. 7, an holding upper die 800 and a pressing upper die 810 arranged at a circumference thereof are lowered in the direction of arrows of k and 1, and the holding upper die 800 makes the base plate 3 pushingly held, thereby holding the base plate 3 between the holding upper die 800 and the lower die 700, and the base plate 3 is bent by the pressing upper die 810, with the result that the cylindrical portion 2 is formed.

Thus, the cylindrical member 1 provided with the extrusive portion 32 and the cylindrical portion 2 is subjected to the steps illustrated in FIGS. 3 and 4.

Extending the cylindrical portion 2 may be conducted at much more phases than two phases.

In a method of forming a cylindrical portion of a cylindrical member made of a sheet metal according to the present invention, a cylindrical portion thinned and extended does not widen to the end, so that the cylindrical member can be available for a pulley, a gear or the like by applying various kinds of processes t o the resulting cylindrical portion.

We claim:

1. A method of forming a cylindrical portion of a cylindrical member made of sheet metal, the cylindrical portion defining an opening end side and a root portion side, comprising the steps of:

fitting a cylindrical portion of a cylindrical member between rotating dies, the cylindrical member having a base plate whose outer periphery is connectedly provided with the cylindrical portion projecting from one side of the base plate, rotating the cylindrical member with the rotating dies, and pressing the cylindrical portion by a forming roller against the rotating dies, so as to thin the cylindrical portion, and extend it axially, wherein a pressed portion of the cylindrical portion pressed by the forming roller is moved in phases, at the opening end side of the cylindrical portion and thereafter at the root portion side thereof.

2. A method of forming a cylindrical portion of a cylindrical member made of a sheet metal according to claim 1, wherein the pressed portion pressed by the forming roller includes two sections, namely a first phase-pressed portion of the opening end side of the cylindrical portion in a first phases and a second phase-pressed portion of the root portion side thereof in a second phase.

3. A method of forming a cylindrical portion of a cylindrical member made of a sheet metal according to claim 2, wherein, a clearance between the cylindrical portion and the rotating die is formed when pressing the pressed portion in association with at least the second phase by the forming roller.

4. A method of forming a cylindrical portion of a cylindrical member made of a sheet metal according to claim 2, wherein, the cylindrical portion is extended in both sides of an axial direction when pressing the root portion side of the cylindrical portion by the forming roller.

5. A method of forming a cylindrical portion of a cylindrical member made of a sheet metal according to claim 4, wherein, a clearance between the cylindrical portion and the rotating die is formed when pressing the pressed portion in association with at least the second phase by the forming roller.

* * * * *